US009432766B2

(12) United States Patent
Jensen et al.

(10) Patent No.: US 9,432,766 B2
(45) Date of Patent: Aug. 30, 2016

(54) AUDIO PROCESSING DEVICE COMPRISING ARTIFACT REDUCTION

(71) Applicant: OTICON A/S, Smørum (DK)

(72) Inventors: Jesper Jensen, Smørum (DK); Michael Syskind Pedersen, Smørum (DK)

(73) Assignee: OTICON A/S, Smorum (DK)

( * ) Notice: Subject to any disclaimer, the term of this patent is extended or adjusted under 35 U.S.C. 154(b) by 96 days.

(21) Appl. No.: 14/109,556

(22) Filed: Dec. 17, 2013

(65) Prior Publication Data

US 2014/0177868 A1 Jun. 26, 2014

Related U.S. Application Data

(60) Provisional application No. 61/738,407, filed on Dec. 18, 2012.

(30) Foreign Application Priority Data

Dec. 18, 2012 (EP) ..... 12197643

(51) Int. Cl.

| | |
|---|---|
| ***H04R 3/00*** | (2006.01) |
| *G10L 25/51* | (2013.01) |
| *G10L 21/0208* | (2013.01) |
| *G10L 25/18* | (2013.01) |

(52) U.S. Cl.

CPC ..... *H04R 3/002* (2013.01); *G10L 21/0208* (2013.01); *G10L 25/18* (2013.01); *G10L 25/51* (2013.01); *G10L 2021/02085* (2013.01)

(58) Field of Classification Search

None

See application file for complete search history.

(56) References Cited

U.S. PATENT DOCUMENTS

2012/0134508 A1* 5/2012 Inoue et al. ..... 381/94.1

FOREIGN PATENT DOCUMENTS

| | | |
|---|---|---|
| EP | 2 144 233 A2 | 1/2010 |
| EP | 2 463 856 A1 | 6/2012 |

OTHER PUBLICATIONS

Fastl et al., "Psycho-Acoustics Facts and Models," 3rd Edition, Springer, 2007, pp. 61-110 and pp. 194-202.

Uemura et al., "Automatic Optimization Scheme of Spectral Subtraction Based on Musical Noise Assessment Via Higher-Order Statistics," Proc. ICASSP, 2012, 4 pages.

Uemura et al., "Musical Noise Generation Analysis for Noise Reduction Methods Based on Spectral Subtraction and MMSE STSA Estimation," ICASSP, 2009, pp. 4433-4436.

Yu et al., "Black Box Measurement of Musical Tones Produced by Noise Reduction Systems," ICASSP, 2012, pp. 4573-4576.

* cited by examiner

*Primary Examiner* — Andrew L Sniezek

(74) *Attorney, Agent, or Firm* — Birch, Stewart, Kolasch & Birch, LLP

(57) ABSTRACT

An improved scheme for identifying and removing musical noise in an audio processing device can be achieved in an audio processing device that includes an analysis path with a perceptive model of the human auditory system and provides an audibility measure. The device may also identify an artifact introduced into the processed signal by the processing algorithm and provide an artifact identification measure, and control a gain applied to a signal of the forward path by the processing algorithm based on the perceptive model. An advantage is to dynamically optimize noise reduction with a view to audibility of artifacts and is applicable to hearing aids, headsets, ear phones, active ear protection systems, hands-free telephone systems, mobile telephones, teleconferencing systems, public address systems, karaoke systems, and classroom amplification systems.

20 Claims, 8 Drawing Sheets

AUDIO PROCESSING DEVICE COMPRISING ARTIFACT REDUCTION

CROSS-REFERENCE TO RELATED APPLICATIONS

This application claims priority under 35 U.S.C. §119(e) to U.S. Provisional Application No. 61/738,407 filed on Dec. 18, 2012. This application also claims priority under U.S.C. §119(a) to Patent Application No. 12197643.5 filed in Europe on Dec. 18, 2012. The entire contents of all the above applications are hereby incorporated by reference.

TECHNICAL FIELD

The present application relates to audio processing devices, in particular to identification of artifacts due to processing (e.g. noise reduction) algorithms in audio processing devices and in particular to reduction of musical noise. The disclosure relates specifically to an audio processing device comprising a forward path for processing an audio signal, the processing comprising the application of a processing (e.g. noise reduction) algorithm to a signal of the forward path.

The disclosure furthermore relates to the use of such device and to a method of operating an audio processing device. The disclosure further relates to a data processing system comprising a processor and program code means for causing the processor to perform at least some of the steps of the method.

Embodiments of the disclosure may e.g. be useful in applications such as hearing aids, headsets, ear phones, active ear protection systems, handsfree telephone systems, mobile telephones, teleconferencing systems, public address systems, karaoke systems, classroom amplification systems, etc.

BACKGROUND

The following account of the prior art relates to one of the areas of application of the present application, hearing aids.

Many state of the art hearing aids are equipped with a single-channel noise reduction (SC-NR) algorithm. In some modern hearing aids, the signal is represented internally as a time-frequency representation (which for multi-microphone hearing aids could be an output of a beamformer or directionality algorithm). A SC-NR algorithm applies a gain value to each time-frequency unit to reduce the noise level in the signal. The term 'gain' is in the present application used in a general sense to include amplification (gain >1) as well as attenuation (gain <1) as the case may be. In a noise reduction algorithm, however, the term 'gain' is typically related to 'attenuation'. Specifically, a SC-NR algorithm estimates the signal-to-noise ratio (SNR) for each time-frequency coefficient and applies a gain value to each time-frequency unit based on this SNR estimate. Eventually, the noise-reduced (and possibly amplified and compressed) time-domain signal is reconstructed by passing the time-frequency representation of the noise-reduced signal through a synthesis filter bank.

When applying the gain to the time-frequency units, the SC-NR algorithm invariably introduces artifacts, because it bases its decisions on SNR estimates. The true SNR values are obviously not observable, since only the noisy signal is available. Some of these artifacts are known as "musical noise", which are perceptually particularly annoying. It is well-known that the amount of "musical noise" can be reduced by limiting the maximum attenuation that the SC-NR is allowed to perform (cf. e.g. EP 2 463 856 A1), in other words by applying a 'less aggressive' noise reduction algorithm. The following tradeoff exists: 1) Larger maximum attenuation implies better noise reduction, but higher risk of introducing musical artifacts, and, on the other hand, 2) Lower maximum attenuation reduces the risk of musical artifacts but makes the noise reduction less effective. Therefore, an ideal maximum attenuation exists. However, the ideal maximum attenuation is dependent on input signal type, general SNR, frequency, etc. So, the ideal maximum attenuation is not fixed across time, but must be adapted to changing situations (as reflected in the input signal).

Recently, objective measures have been presented for estimating the amount of musical noise in a given noise-reduced signal, based on the noise-reduced signal itself, and the original noisy signal, the latter being the input to the SC-NR system (cf. e.g. [Uemura et al.; 2012], [Yu & Fingerscheidt; 2012] and [Uemura et al.; 2009]). More specifically, in [Uemura et al.; 2009] it is proposed to compare characteristics of the noisy unprocessed signal with signal characteristics of the noise-reduced signal to determine to which extent musical noise is present in the noise-reduced signal. It is found that the change (the ratio, in fact) of the signal kurtosis is a robust predictor of musical noise. Based on this measure, it is proposed in EP 2 144 233 A2 to adjust the parameters of the noise reduction algorithm (e.g., the maximum attenuation) to reduce the amount of musical noise (at the price of reduced noise reduction).

EP 2 144 233 A2 describes a noise suppression estimation device that calculates a noise index value, which varies according to kurtosis of a frequency distribution of magnitude of a sound signal before or after suppression of the noise component, the noise index value indicating a degree of occurrence of musical noise after suppression of the noise component in a frequency domain. A schematic block diagram reflecting such control of a noise reduction algorithm is shown in FIG. 1.

WO2008115445A1 deals with speech enhancement based on a psycho-acoustic model capable of preserving the fidelity of speech while sufficiently suppressing noise including the processing artifact known as "musical noise".

WO2009043066A1 deals with a method for enhancing wide-band speech audio signals in the presence of background noise, specifically to low-latency single-channel noise reduction using sub-band processing based on masking properties of the human auditory system. WO0152242A1 deals with a multi-band spectral subtraction scheme comprising a multi-band filter architecture, noise and signal power detection, and gain function for noise reduction. WO9502288A1 deals with properties of human audio perception used to perform spectral and time masking to reduce perceived loudness of noise added to speech signals.

SUMMARY

A weakness of the prior art kurtosis-ratio-based musical noise measure is that it treats each and every time-frequency unit identically and does not take into account aspects of the human auditory system (although the basic goal of it is to predict perceived quality of a noise-reduced signal). More specifically, time-frequency units which are completely masked by other signal components, and which are therefore completely unavailable to the listener, will still contribute to the traditional kurtosis-ratio based measure, leading to erroneous predictions of the musical noise level.

An object of the present application is to provide an improved scheme for identifying and removing artifacts, e.g. musical noise, in an audio processing device.

Objects of the application are achieved by the invention described in the accompanying claims and as described in the following.

An Audio Processing Device:

In an aspect of the present application, an object of the application is achieved by an audio processing device comprising a forward path comprising an input unit for delivering a time varying electric input signal representing an audio signal, the electric input signal comprising a target signal part and a noise signal part, a signal processing unit for applying a processing algorithm to said electric input signal and providing a processed signal, and an output unit for delivering an output signal based on said processed signal.

The audio processing device further comprises, an analysis path comprising a model unit comprising a perceptive model of the human auditory system and providing an audibility measure, an artifact identification unit for identifying an artifact introduced into the processed signal by the processing algorithm and providing an artifact identification measure, and a gain control unit for controlling a gain applied to a signal of the forward path by the processing algorithm based on inputs from said model unit and said artifact identification unit.

An advantage of the present disclosure is to dynamically optimize noise reduction with a view to audibility of artifacts.

The term 'forward path' is in the present context taken to mean a forward signal path comprising functional components for providing, propagating and processing an input signal representing an audio signal to an output signal.

The term 'analysis path' is in the present context taken to mean an analysis signal path comprising functional components for analysing one or more signals of the forward path and possibly controlling one or more functional components of the forward path based on results of such analysis.

The term 'artifact' is in the present context of audio processing taken to mean elements of an audio signal that are introduced by signal processing (digitalization, noise reduction, compression, etc.) that are in general not perceived as natural sound elements, when presented to a listener. The artifacts are often referred to as musical noise, which are due to random spectral peaks in the resulting signal. Such artifacts sound like short pure tones. Musical noise is e.g. described in [Berouti et al.; 1979], [Cappe; 1994] and [Linhard et al.; 1997].

According to the present disclosure, gain (attenuation) of the processing (e.g. noise reduction) algorithm at the given frequency and time is only modified in case the artifact in question is estimated to be audible as determined from a psychoacoustic or perceptual model, e.g. a masking model or an audibility model. Preferably, the attenuation of the processing (e.g. noise reduction) algorithm is optimized to provide that attenuation of noise at a given frequency and time (k,m) is maximized while keeping artifacts (just) inaudible. Psycho-acoustic models of the human auditory system are e.g. discussed in [Fastl & Zwicker, 2007], cf. e.g. chapter 4 on 'Masking', pages 61-110, and chapter 7.5 on 'Models for Just-Noticeable Variations', pages 194-202. An audibility model may e.g. be defined in terms of a speech intelligibility measure, e.g. the speech-intelligibility index (SII, standardized as ANSI S3.5-1997)

In an embodiment, the audio processing device comprises a time to time-frequency conversion unit for converting a time domain signal to a frequency domain signal. In an embodiment, the audio processing device comprises a time-frequency to time conversion unit for converting a time domain signal to a frequency domain signal.

In an embodiment, the time-frequency conversion unit is configured to provide a time-frequency representation of a signal of the forward path in a number of frequency bands k and a number of time instances m, k being a frequency band index and m being a time index, (k, m) thus defining a specific time-frequency bin or unit comprising a complex or real value of the signal corresponding to time instance m and frequency index k.

In general, any available method of identifying and/or reducing a risk of introducing artifacts introduced by a processing algorithm can be used. Examples are methods of identifying gain variance, e.g. fast fluctuations in gains intended for being applied by the processing algorithm. Such methods may include limiting a rate of change the applied gain, e.g. detecting gains that fluctuate and selectively decrease the gain in these cases (cf. e.g. EP2463856A1).

In an embodiment, a predetermined criterion regarding values of the artifact identification measure indicating the presence of an artifact in a given TF-bin (k,m) is defined.

In an embodiment, the artifact identification unit is configured to determine artifacts based on a measure of kurtosis for one or more signals of the forward path. Other measures may be used, though. An alternative measure may be based on a detection of modulation spectra. A modulation spectrum may be determined an associated with each TF-bin (k,m) by making a Fourier transformation of a 'plot' of magnitude or magnitude squared for TF-units of a specific frequency bin k over a number of consecutive time frames (a sliding window comprising a number of previous time frames, cf. e.g. FIG. 5, top graph). The resulting plot of magnitude or magnitude squared versus frequency constitutes the modulation spectrum. A specific peak in a modulation spectrum of a given TF-unit at relatively higher frequencies may be taken as an indication of an artifact. An artifact identification measure may be defined by a peak value of the spectrum (or an integration of the spectrum around an identified peak value).

In an embodiment, the artifact identification unit is configured to determine the artifact identification measure by comparing a kurtosis value based on the electric input signal or a signal originating there from with a kurtosis value based on the processed signal.

In an embodiment, the artifact identification unit is configured to determine the artifact identification measure based on the kurtosis values $K_b(k,m)$ and $K_a(k,m)$ of the input signal or a signal originating there from and of the processed signal, respectively.

In statistics kurtosis describes a degree of peakedness (or 'peak steepness') of a probability function of a random (stochastic) variable X. Several measures of kurtosis K exist. e.g. Pearsons':

$$K = \frac{\mu_4}{\sigma^4} = \frac{\mu_4}{\mu_2^2} = \frac{E[(X-\mu)^4]}{\sigma^4}$$

where $\mu$ is the mean value of X, $\mu_4$ is the fourth moment about the mean, $\sigma$ is the standard deviation ($\mu_2$ is the second moment and equal to the variance $Var(X)=\sigma^2$), and E[■] is the expected value operator of ■.

The n'th order moment $\mu_n$ is defined by $$\mu_n=\int_0^\infty X^n P(X)dX$$

where P(X) is the probability density function of X (cf. e.g. [Uemura et al.; 2009]).

In an embodiment, the artifact identification measure AIDM(k,m) comprises a kurtosis ratio $K_a(k,m)/K_b(k,m)$. In an embodiment, the predetermined criterion is defined by the kurtosis ratio $K_a(k,m)/K_b(k,m)$ being larger than or equal to a predefined threshold value $AIDM_{TH}$.

In an embodiment, the audio processing device comprises an SNR unit for dynamically estimating an SNR value based on estimates of the target signal part and/or the noise signal part. In an embodiment, the SNR unit is configured to determine an estimate of a signal to noise ratio.

In an embodiment, the audio processing device comprises a voice activity detector (VAD) configured to indicate whether or not a human voice is present in the input audio signal at a given point in time (e.g. by a VOICE and NO-VOICE indication, respectively).

In an embodiment, the audio processing device, e.g. the artifact identification unit, is configured to perform the analysis of kurtosis during time spans where no voice is present in the electric input signal (as e.g. indicated by a voice activity detector).

The processing algorithm preferably comprises processing steps for enhancing a user's perception of the current electric input signal. In an embodiment, the algorithm comprises a compression algorithm. In a preferred embodiment, the processing algorithm comprises a noise reduction algorithm, e.g. a single-channel noise reduction (SC-NR) algorithm. In an embodiment, the noise reduction algorithm is configured to vary the gain between a minimum value and a maximum value. In an embodiment, the noise reduction algorithm is configured to vary the gain in dependence of the SNR value.

An artifact indication measure can be determined for a given signal before and after the application of a processing algorithm, e.g. a noise reduction algorithm for reducing noise in an audio signal comprising speech, cf. e.g. signals x(n) and z(n) in FIG. 1, x(n) and z(n) being time variant audio signals. Preferably, the time variant signals x(n) and z(n) are converted to the time-frequency domain thereby providing signals x(km) and z(k,m), k and m being frequency and time indices, respectively. Values of a signal (x or z) having a particular index k (and any index m, e.g. x(k,*)) represent a particular frequency or frequency band of the signal. Values of a signal (x or z) having a particular index m (and any index k, e.g. x(*,m)) represent a particular time or time frame of the signal. In an embodiment, values of a signal (e.g. x or z) at a particular frequency and time (k,m), here termed a time-frequency (TF) bin or unit, are represented by a complex number, e.g. in the form of Fourier coefficients of a Fourier transformed signal, e.g. DFT-coefficients (DFT=discrete Fourier transform), or FFT-coefficients (FFT=fast Fourier transform).

In an embodiment, only the magnitude (or magnitude squared) of a TF-bin of a signal of the forward path (e.g. x or z) is considered when determining a resulting gain of the processing algorithm. In an embodiment, the energy of each time-frequency bin is determined as the magnitude squared ($|■|^2$) of the signal in the TF-bins in question.

In an embodiment, the audio processing device comprises an analogue-to-digital (AD) converter for converting an analogue electric signal representing an acoustic signal to a digital audio signal. In an embodiment, the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. In an embodiment, the signals of a particular frequency band (index k) are analyzed over a certain time span (e.g. more than 100 ms or 200 ms), e.g. a particular number $N_f$ of time frames of the signal. In an embodiment, a sampling frequency $f_s$ is larger than 16 kHz, e.g. equal to 20 kHz (corresponding to a sample length in time of $1/f_s$=50 μs). In an embodiment, a number of audio samples are arranged in a time frame. In an embodiment, the number of samples in a time frame is 64 (corresponding to a frame length in time of 3.2 ms) or more. In an embodiment, the number of time frames $N_f$ of the (sliding) window constituting the analyzing time span is larger than 20 such as larger than 50.

In an embodiment, the audio processing device, e.g. the artifact identification unit, is configured to determine a probability density function p(k,m) of the energy of a signal of the forward path. According to the present disclosure, a kurtosis parameter K(k,m) is determined for a probability density function of the energy (magnitude squared, $|■|^2$) at a given frequency (k) and time (m) of a signal of the forward path of the audio processing device before ($K_b(k,m)$) and after ($K_a(k,m)$) the processing algorithm in question, e.g. a noise reduction algorithm. A kurtosis parameter K(k,m) at a particular frequency k and time instance m is based on a number of previous time frames, e.g. corresponding to a sliding window (e.g. the $N_f$ previous time frames relative to a given (e.g. present) time frame, cf. e.g. FIG. 5).

An artifact identification measure AIDM(k,m) based on the kurtosis parameters $K_b(k,m)$ and $K_a(k,m)$ signals of the forward path (e.g. a kurtosis ratio $K_a(k,m)/K_b(k,m)$, or difference $K_a(k,m)-K_b(k,m)$, or other functional relationship between the two) can be defined. A predetermined criterion regarding the value of the artifact identification measure is defined, e.g. $K_a(k,m)/K_b(k,m)\geq AIDM_{TH}$. In an embodiment, $AIDM_{TH}\geq 1.2$, e.g. $\geq 1.5$. If the predefined criterion is fulfilled by the artifact identification measure of a given TF-bin, an artifact at that frequency and time is identified.

In an embodiment, the gain control unit is configured to modify a gain of the processing algorithm (e.g. noise reduction algorithm, where an attenuation is reduced), if an artifact is identified. In an embodiment, the modification comprises that a reduction of a gain (i.e. an attenuation) otherwise intended to be applied by the processing algorithm is reduced with a predefined amount $\Delta G$ (e.g. eliminated, i.e. no attenuation, gain=1). In an embodiment, the modification comprises that a reduction of gain (an attenuation) otherwise intended to be applied by the processing algorithm is gradually modified in dependence of the size of the artifact identification difference measure. In an embodiment, attenuation is reduced with increasing kurtosis ratio and vice versa (i.e. increased with decreasing kurtosis ratio). In an embodiment, the gain control unit is configured to limit a rate of the modification, e.g. to a value between 0.5 dB/s and 5 dB/s.

In an embodiment, the perceptive model comprises a masking model configured to identify to which extent an identified artifact of a given time-frequency unit of the processed signal or a signal derived there from is masked by other elements of the current signal.

In an embodiment, the gain control unit is configured to dynamically modify the gain of the noise reduction algorithm otherwise intended to be applied by the algorithm to provide that the amount of noise reduction is always at a maximum level subject to the constraint that no (or a minimum of) musical noise is introduced.

The audio processing device comprises a forward or signal path between an input unit, e.g. an input transducer (e.g. comprising a microphone system and/or direct electric input (e.g. a wireless receiver)) and an output unit, e.g. an output transducer. A signal processing unit is located in the forward path. In an embodiment, the signal processing unit—in addition to the processing algorithm—is adapted to provide a frequency dependent gain according to a user's particular needs. The audio processing device comprises an analysis path comprising functional components for analyzing the input signal, including determining a signal to noise ratio, a kurtosis value, etc. In an embodiment, the analysis path comprises a unit for determining one or more of a level, a modulation, a type of signal, an acoustic feedback estimate, etc. In an embodiment, some or all signal processing of the analysis path and/or the signal path is conducted in the frequency domain. In an embodiment, some or all signal processing of the analysis path and/or the signal path is conducted in the time domain.

In an embodiment, the audio processing device comprises a digital-to-analogue (DA) converter to convert a digital signal to an analogue output signal, e.g. for being presented to a user via an output transducer.

In an embodiment, the time to time-frequency (TF) conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the audio processing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the audio processing device is split into a number NI of frequency bands, where NI is e.g. larger than 5, such as larger than 10, such as larger than 50, such as larger than 100, such as larger than 500, at least some of which are processed individually. In an embodiment, the audio processing device is/are adapted to process a signal of the forward and/or analysis path in a number NP of different frequency channels (NP 5. NI). The frequency channels may be uniform or non-uniform in width (e.g. increasing in width with frequency), overlapping or non-overlapping.

In an embodiment, the audio processing device comprises a frequency analyzing unit configured to determine a power spectrum of a signal of the forward path, the power spectrum being e.g. represented by a power spectral density, PSD(k), k being frequency index, the total power of the power spectrum at a given point in time m being determined by a sum or integral of PSD(k) over all frequencies at the given point in time). In an embodiment, the frequency analyzing unit is configured to determine a probability density function of the energy (magnitude squared, $|\blacksquare|^2$) at a given frequency (k) and time (m) of a signal of the forward path of the audio processing device based on a number of previous time frames, e.g. corresponding to a sliding window (e.g. the $N_f$ previous time frames relative to a given (e.g. present) time frame).

In an embodiment, the audio processing device comprises a number of microphones and a directional unit or beamformer for providing a directional (or omni-directional) signal. Each microphone picks up a separate version of a sound field surrounding the audio processing device and feeds an electric microphone signal to the directional unit. The directional unit forms a resulting output signal as a weighted combination (e.g. a weighted sum) of the electric microphone signals. In an embodiment, the processing algorithm is applied to one or more of the electric microphone signals. Preferably, however, the processing algorithm is applied to the resulting (directional or omni-directional) signal from the directional unit.

In an embodiment, the audio processing device comprises an acoustic (and/or mechanical) feedback suppression system. In an embodiment, the audio processing device further comprises other relevant functionality for the application in question, e.g. compression.

In an embodiment, the audio processing device comprises a listening device, such as a hearing aid, e.g. a hearing instrument, e.g. a hearing instrument adapted for being located at the ear or fully or partially in the ear canal of a user, or a headset, an earphone, an ear protection device or a combination thereof.

Use:

In an aspect, use of an audio processing device as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the loudspeaker to the microphone during operation by a user. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A method:

In an aspect, a method of operating an audio processing device comprising a forward path for applying a processing algorithm to an audio input signal and an analysis path for analyzing signals of the forward path to control the processing algorithm, the method comprising a) delivering a time varying electric input signal representing an audio signal, the electric input signal comprising a target signal part and a noise signal part;
b) applying a processing algorithm to said electric input signal and providing a processed signal;
c) delivering an output signal based on said processed signal is furthermore provided by the present application.

The method further comprises d) providing a perceptive model of the human auditory system;
e) identifying an artifact introduced into the processed signal by the processing algorithm and providing an artifact identification measure, and
f) controlling a gain applied to a signal of the forward path by the processing algorithm based on said perceptive model and said artifact identification measure.

It is intended that some or all of the structural features of the audio processing device described above, in the 'detailed description of embodiments' or in the claims can be combined with embodiments of the method, when appropriately substituted by a corresponding process and vice versa. Embodiments of the method have the same advantages as the corresponding devices.

In an embodiment, the method further comprises dynamically estimating an SNR value based on estimates of a said target signal part and/or said noise signal part;

determining an artifact identification measure by comparing a kurtosis value based on said electric input signal or a signal originating there from with a kurtosis value based on said processed signal, controlling a gain applied to a signal of the forward path by the processing algorithm based on said SNR value, said artifact identification measure and said perceptive model.

In an embodiment, the method comprises identifying whether or not a human voice is present in the input audio signal at a given point in time. In an embodiment, the method comprises that the analysis of kurtosis is only performed during time spans where no voice is present in the electric input signal.

In an embodiment, the method provides that the processing algorithm comprises a noise reduction algorithm, e.g. a single-channel noise reduction (SC-NR) algorithm.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

An Audio Processing System:

In a further aspect, an audio processing system comprising an audio processing device as described above, in the 'detailed description of embodiments', and in the claims, AND an auxiliary device is moreover provided.

In an embodiment, the system is adapted to establish a communication link between the audio processing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the audio processing device. In an embodiment, the auxiliary device is or comprises a remote control for controlling functionality and operation of the audio processing device(s).

In an embodiment, the auxiliary device is another audio processing device. In an embodiment, the audio processing system comprises two audio processing devices adapted to implement a binaural audio processing system, e.g. a binaural hearing aid system. In a preferred embodiment, information about the control of the processing algorithm (e.g. a noise reduction algorithm) is exchanged between the two audio processing devices (e.g. first and second hearing instruments), e.g. via a specific inter-aural wireless link (IA-WLS in FIG. 4), thus allowing a harmonized control of the processing algorithms of the respective hearing instruments. Specifically, the audio processing system is configured to provide that information about the control of gains of time-frequency regions for which gains should be increased (attenuation reduced) to reduce the risk of producing audible artifacts is exchanged between the two audio processing devices (e.g. first and second hearing instruments).

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Figure 1:
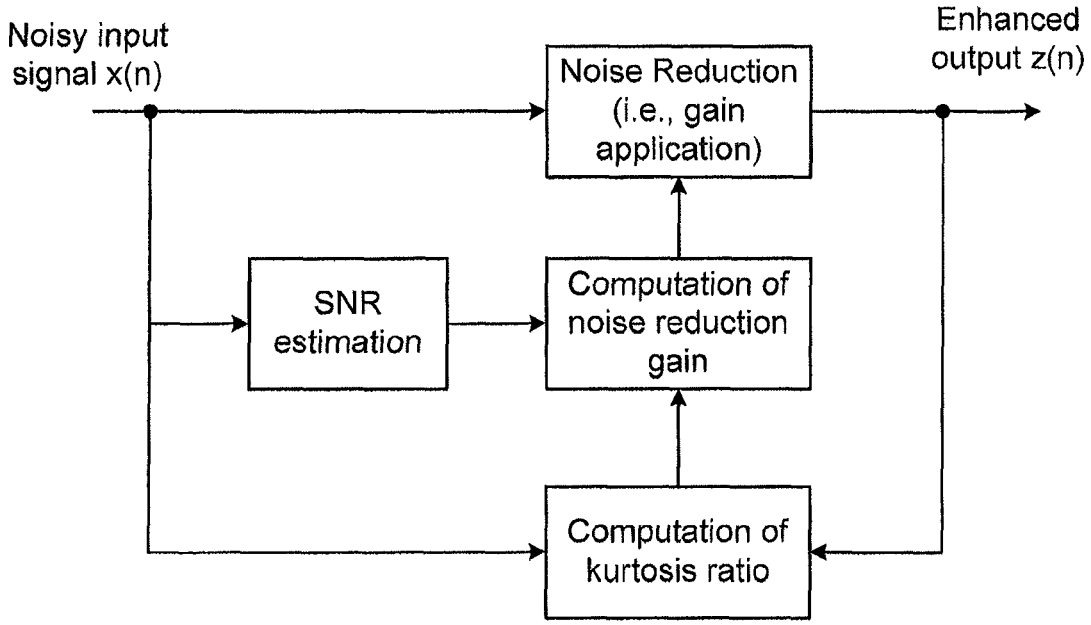
FIG. 1 PRIOR ART
FIG. 1 shows a prior art noise reduction system.
Figure 2A:
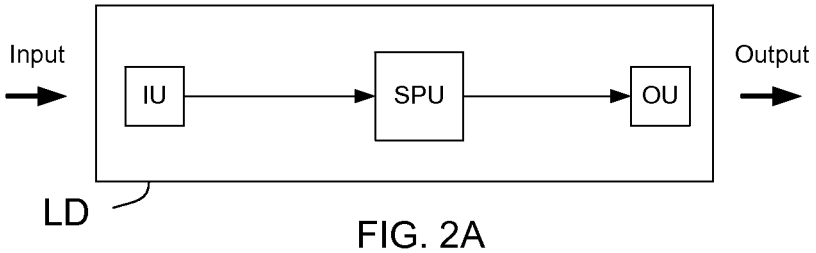
FIGS. 2A-2D shows four embodiments of an audio processing device according to the present disclosure.
Figure 2B:
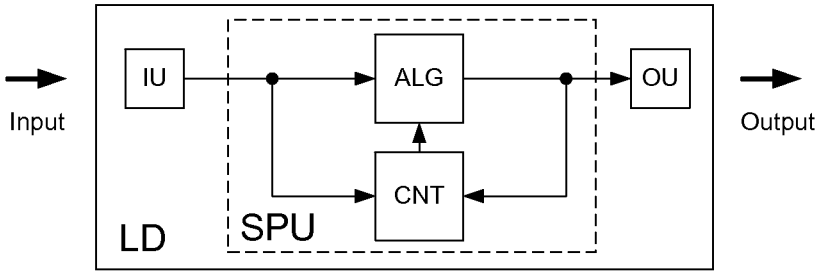
Figure 2C:
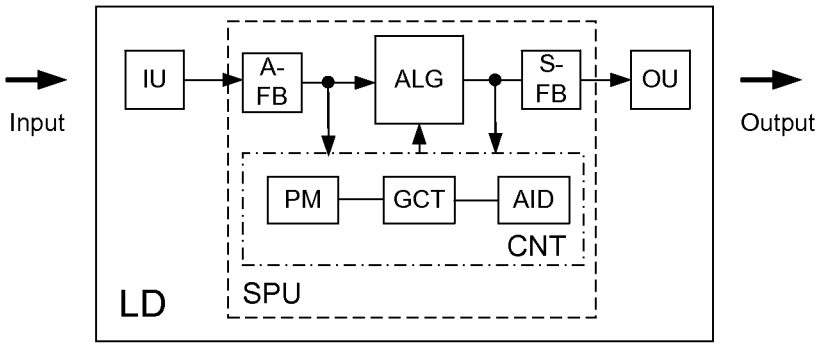
Figure 2D:
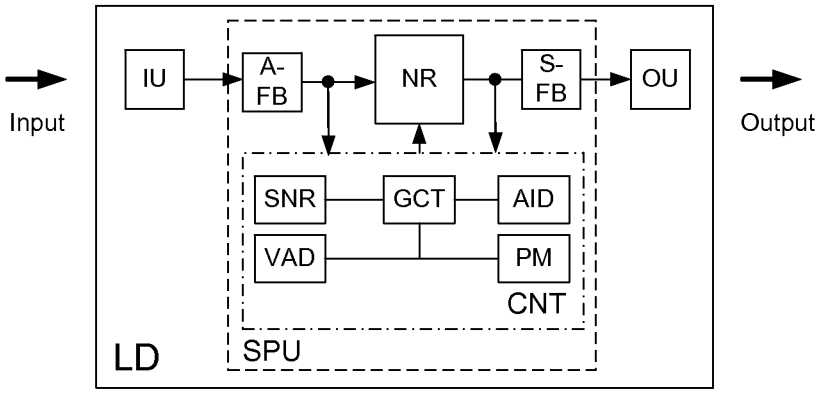

FIG. 1 shows a prior art noise reduction system, e.g. for forming part of an audio processing device, e.g. a hearing instrument. FIG. 1 schematically illustrates components of a noise reduction system for reducing noise in an input audio signal x(n) and to provide an Enhanced output signal z(n). Index n is a time index implying the time variance of the signals. The noise reduction system is configured to compare characteristics of the Noisy (unprocessed) input signal x(n) with signal characteristics of the noise-reduced signal z(n) to determine to which extent musical noise is present in the noise-reduced signal. It is found that the change of the signal kurtosis is a robust predictor of musical noise. Based on this measure, it has been proposed in EP 2 144 233 A2 to adjust the parameters of the noise reduction algorithm (e.g., the maximum attenuation) to reduce the amount of musical noise (at the price of reduced noise reduction). Time variant signals x(n) and z(n) are e.g. signals of a forward path of an audio processing device. A noise reduction algorithm (cf. signal processing unit Noise Reduction (i.e. gain application) in FIG. 1) is applied to signal x resulting in enhanced signal z. The algorithm may be configured to work on an input signal x in the time domain and provide a resulting signal z in the time domain. Preferably, however, the noise reduction algorithm works on signals in the frequency domain, e.g. in that the noisy input signal x(n) is provided as a band split signal (e.g. as a map of time-frequency (TF) bins (k,m), each defining the signal at a particular frequency k and time m). Alternatively, the time to time-frequency conversion may be performed in the Noise Reduction unit. The resulting signal z(n) may be further processed in the time or frequency domain, e.g. by a gain unit for applying a frequency dependent gain to compensate for a user's hearing loss. An analysis path is formed by a) an SNR estimation unit for dynamically estimating a signal to noise ratio of a TF-bin, b) a Computation of kurtosis ratio unit for determining a kurtosis ratio K(x)/K(z)) by comparing respective kurtosis values for a given TF-bin (k,m) based on signals x(k,m) and z(k,m), and c) a Computation of noise reduction gain control unit for controlling a gain applied to a signal of the forward path by the noise reduction algorithm (Noise Reduction (i.e. gain application) unit) based on the SNR value and the artifact identification measure for the TF-bin (k,m) in question.

FIG. 2 shows four embodiments of an audio processing device according to the present disclosure. FIG. 2 simply illustrates basic components of an audio processing device, e.g. a listening device LD, comprising a forward path for receiving an input audio signal (Input) and delivering an enhanced output audio signal (Output). The forward path comprises (as shown in to FIG. 2A in its simplest form) an input unit (IU) (e.g. an input transducer or an electrical connection point) for providing an electric input signal representing the audio signal, a signal processing unit (SPU) for applying a processing algorithm to a signal of the forward path and providing a processed output signal, and an output unit (OU) (e.g. an output transducer or an electrical connection point) for delivering the processed output signal, either for presentation to a user as a an audible stimulus (Output) and/or to another unit or device for further processing. In the embodiment shown in FIG. 2B, the signal processing unit (SPU) is shown to comprise a processing unit (ALG) in the forward path and to implement an analysis path comprising a control unit (CNT) for controlling an algorithm of processing unit (ALG). The control unit (CNT) receives input signals from the forward path before and after the processing unit (ALG), respectively. In the embodiment shown in FIG. 2C, the part of the forward path implemented by processing unit (SPU) is shown to further comprise analysis filter bank (A-FB) for providing input signals to the processing unit (ALG) and to the control unit (CNT) in the time-frequency domain. Alternatively, such time to time frequency conversion may be performed in the input unit (IU) or elsewhere (e.g. prior to the input unit (IU)) to provide that signals of the forward path as well as the analysis path are represented in the (time-) frequency domain. In the embodiment of FIG. 2C the forward path—prior to the output unit (OU)—further comprises a synthesis filter bank (S-FB) allowing a presentation of a signal to output unit OU in the time domain. The control unit (CNT) of the embodiment of FIG. 2C comprises a gain control unit (GCT) for determining a gain (e.g. an attenuation, or an amplification) or another parameter and applying the gain (or another parameter) to an algorithm of the processing unit (ALG). The gain control unit (GCT) determines the relevant gain based on inputs from an artifact detector (AID) and a perceptual model (PM). A further embodiment of an audio processing device (comprising the same functional elements as shown in FIG. 2C) is illustrated in FIG. 2D, wherein the algorithm of the processing unit is a noise reduction algorithm (indicated by denoting the processing unit NR). The control unit (CNT)—in addition to gain control unit (GCT), artifact identification unit (AID), and model unit (PM) comprising a perceptual model—further comprises a voice activity detector (VAD), and a unit (SNR) for estimating a signal to noise ratio. The gain control unit (GCT) is configured to base its determination of gain for a particular TF-unit (k,m) on inputs related to that unit from the artifact identification unit (AID), the model unit (PM), the voice activity detector (VAD), and the SNR unit (SNR).

Figure 3A:
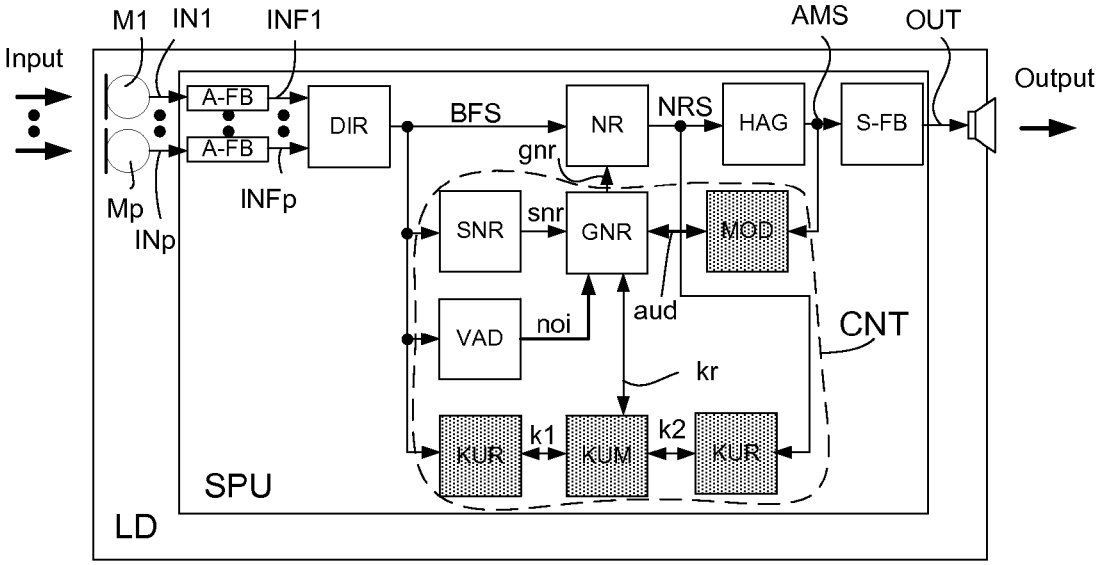
FIG. 3 shows in FIG. 3A an embodiment of an audio processing device (comprising a noise reduction system), and in FIG. 3B an embodiment of a noise reduction system according to the present disclosure.
Figure 3B:
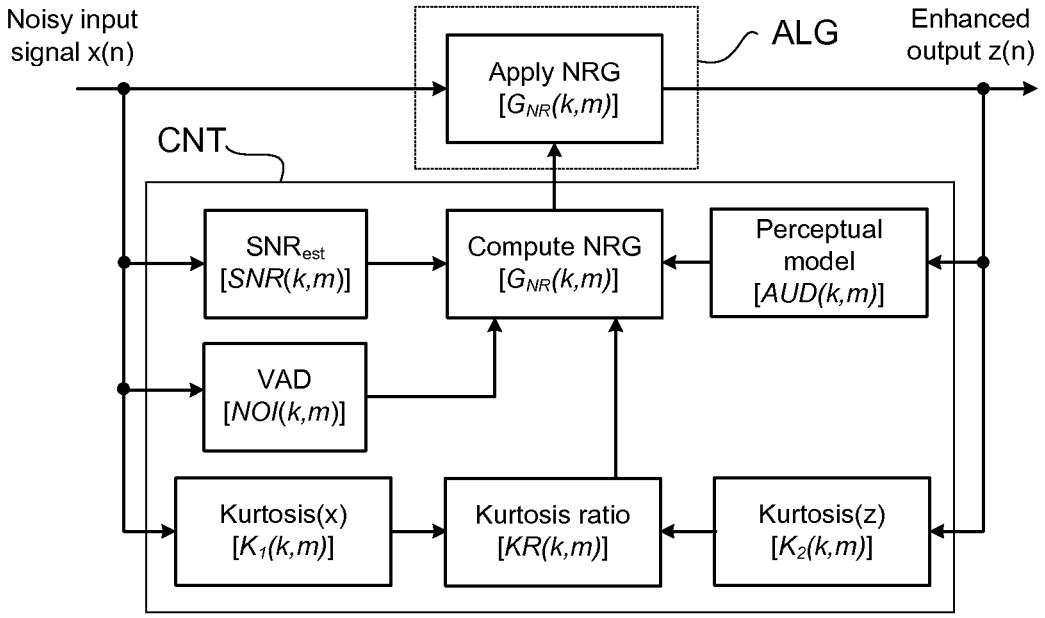

FIG. 3 shows in FIG. 3A an embodiment of an audio processing device (comprising a noise reduction system), and in FIG. 3B an embodiment of a noise reduction system according to the present disclosure. The audio processing device of FIG. 3A is embodied in a listening device LD having the same basic components as illustrated in FIG. 2, i.e. a) an input unit (here comprising a number of input transducers (here microphones) M1, . . . , Mp, each for picking up a specific part of an Input sound field, and each being connected to an analysis filter bank (A-FB) for providing a time-frequency representation INF1, . . . , INFp of a respective microphone signal IN1, . . . , INp), b) a signal processing unit (SPU) (here shown to comprise the analysis filter banks (A-FB) and a synthesis filter bank (S-FB) for providing a time-domain output signal OUT), and c) an output unit comprising and output transducer, here a loudspeaker, for presenting the output signal to one or more users as a sound. The audio processing device of FIG. 3A is shown to have a single loudspeaker, which is e.g. relevant for a hearing aid application, but may alternatively comprise a larger number of loudspeakers, e.g. two or three or more, depending on the application. A number of loudspeakers may e.g. be relevant in a public address system.

Figure 6:
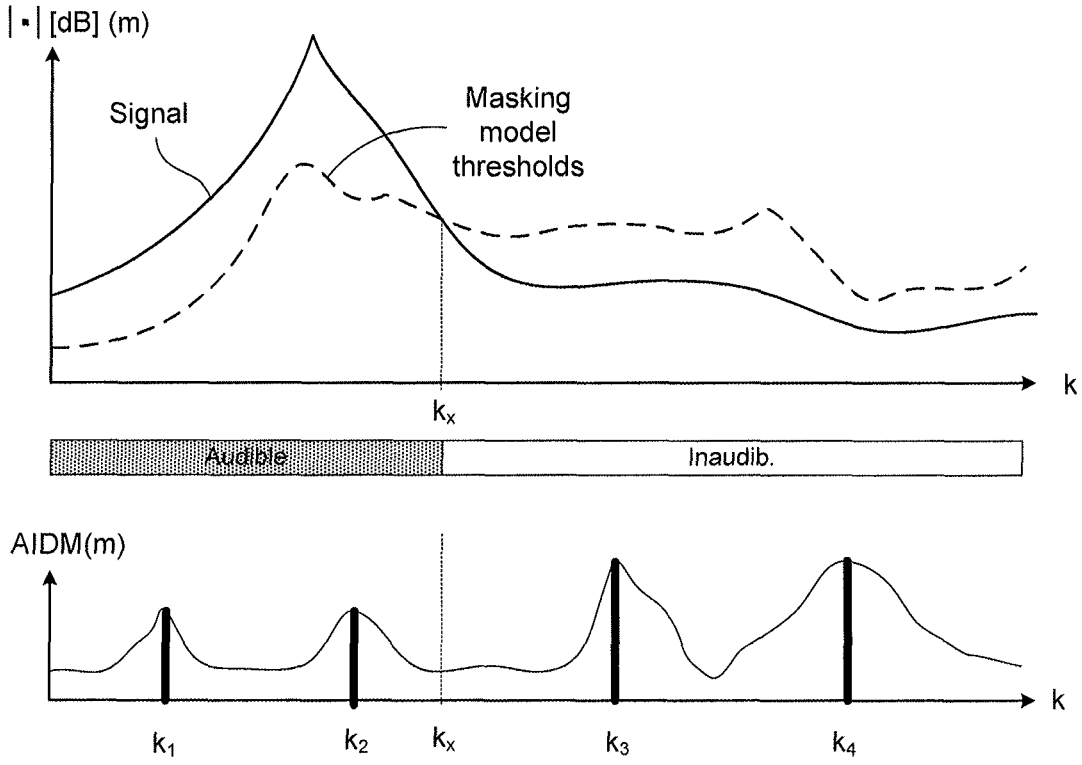
FIG. 6 shows a schematic perceptual model (here a masking model) for a noise signal at a given point in time, and an artefact identification measure AIDM implying a number of exemplary occurrences of artifacts (at the given point in time)
Figure 7:
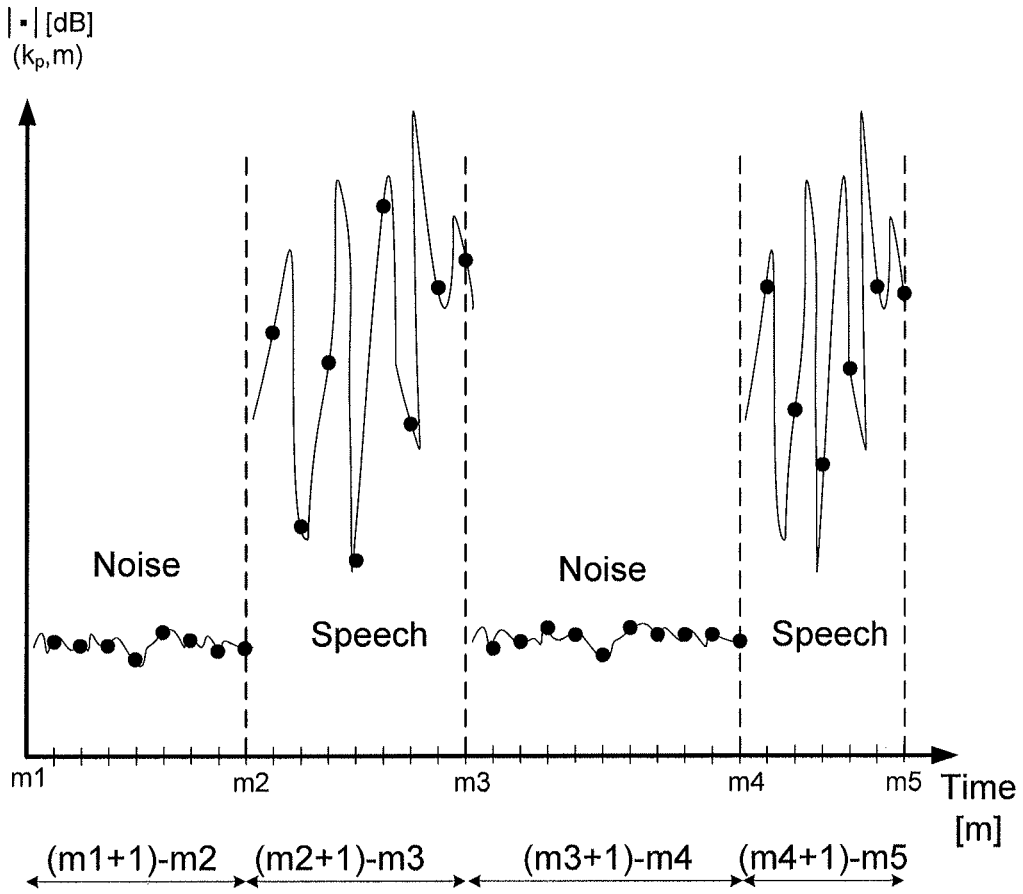
FIG. 7 shows a schematic example of magnitude |■| of a time variant input audio signal in a specific frequency band ($k_p$) comprising time segments of noise-only and time segments of speech in noise the resulting analysis by a voice activity detector.

In the following, the functional units of the signal processing unit (SPU) are described. The analysis filter banks (A-FB) of signal processing unit (SPU) receives time domain microphone signals IN1, . . . , INp and provides time-frequency representations INF1, . . . , INFp of the p microphone input signals. The p TF-representations of the input signals are fed to a directional (or beamforming) unit (DIR) for providing a single resulting directional or omni-directional signal. The resulting output signal BFS of the DIR unit is a weighted combination (e.g. a weighted sum) of the input signals INF1, . . . , INFp. The processing algorithm, here a noise reduction algorithm (NR), is applied to the resulting (directional or omni-directional) signal BFS. The noise reduced signal NRS is fed to a further processing algorithm (HAG) for applying a gain to signal NRS, e.g. a frequency and/or level dependent gain to compensate for a user's hearing loss and/or to compensate for un-wanted sound sources in the sound field of the environment. The output AMS of the further processing algorithm (HAG) is fed to synthesis filter bank (S-FB) for conversion to time-domain signal OUT. The signal processing unit (SPU) further comprises an analysis path comprising a control unit (CNT) for controlling the noise reduction algorithm (NR). The control unit (CNT) comprises the same functional elements shown in FIG. 2D and described in connection therewith. The control unit comprises a voice activity detector (VAD) configured to indicate (signal noi) whether or not a human voice is present in the input audio signal in a given frequency region (k) at a given point in time (m). The control unit (CNT) is configured to only perform the analysis of kurtosis (performed by artifact identification unit (AID in FIG. 2D=KUR, KUM, KUR in FIG. 3A) comprising kurtosis calculation units (KUR) and kurtosis comparison unit (KUM)) during time spans where no voice is present in a given TF-bin of the input audio signal, as indicated by a voice activity detector (VAD). In other words, units KUR, KUM and MOD may be held at standby during time segments identified (e.g. by the VAD) as comprising speech. In case a voice is present in the signal BFS of the forward path subject to the noise reduction algorithm (NR), the influence of possible musical noise is considered negligible (ignored). Thereby processing power is saved. In an embodiment, the voice activity detector (VAD) analyses the full band signal (full frequency range considered by the device LD) and indicates whether or not a voice is present in the signal at a given point in time. Preferably, however, the voice activity detector (VAD) analysis the signal in a time-frequency representation and is configured to indicate the presence of a voice component (e.g. speech) in each time frequency bin (k,m), as schematically illustrated in FIG. 7. In the example of FIG. 7, showing the presence of speech (and noise) or noise only (no speech)—in a magnitude |■| vs. time plot—for a specific frequency band (k=kp) and a number of time units $m_1$, $m_1+1$, . . . , $m_5$, the kurtosis analysis (and thus the search for artifacts due to the applied noise reduction algorithm) is only performed in time units $(m_1+1)-m_2$, and $(m_3+1)-m_4$, where only noise is present (no speech). The model unit (MOD) comprising a perceptive model of the human auditory system receives output signal AMS from the further processing algorithm (HAG, e.g. after an applied gain) to decide whether an artifact identified in a given TF-bin (k,m) is audible or not (signal and to gain control unit GNR). This is illustrated in FIG. 6 in the form of an exemplary noise signal spectrum (solid line) and corresponding masking thresholds (dashed line). The two kurtosis calculation units (KUR) for determining kurtosis values based on signals BFS (before noise reduction) and NRS (after noise reduction), respectively, provide inputs $k_1$ and $k_2$, respectively, to the kurtosis comparison unit (KUM) determining a kurtosis ratio kr. Units KUM and KUR are operatively connected with the gain control unit (GNR) (indicated by double arrows on signals kr, k1 and k2) allowing the latter to control the calculation of respective kurtosis values and kurtosis rations, e.g. to only calculate kurtosis parameters for TF-units comprising a noise-only signal component (as indicated by control signal not from the voice activity detector (VAD) to the gain control unit (GNR)). In case the kurtosis comparison unit (KUM) indicates that an artifact is present in TF-bin (k,m) as communicated by control signal kr to the gain control unit (NRG), and the model unit (MOD) indicates that such artifact is audible as communicated to the gain control unit (GNR) via control signal aud, an appropriately reduced attenuation (increased gain) $G_{NR}(k,m)$ is applied to signal BFS by the algorithm unit (NR). A schematic example of a relation between (minimum) noise reduction gain $G_{NR,min}(k,m)$ and the identification of audible and inaudible artifacts is shown in FIG. 9C.

The noise reduction system as described in the listening device of FIG. 3A is illustrated in FIG. 3B and comprises a forward path comprising a noise reduction algorithm (denoted NR and Apply NRG in FIGS. 3A and 3B, respectively) for enhancing a Noisy input signal x(n) of the forward path and providing an Enhanced output signal z(n), and an analysis path comprising a control part CNT for controlling the noise reduction algorithm.

Kurtosis values $K_1(k,m)$ ($K_1$=K(x)) and $K_2(k,m)$ ($K_2$=K(z)) of signals of the forward path before and after, respectively, the application of the noise reduction algorithm are determined in units Kurtosis(x) and Kurtosis(z), respectively, for the TF-bins in question. According to the present disclosure, a kurtosis value $K_1(k,m)$ or $K_2(k,m)$ is determined for a probability density function p of the energy (magnitude squared, $|■|^2$) at a given frequency (k) and time (m) of the signal ($K_1(k,m)$ and $K_2(k,m)$) in question. A kurtosis parameter K(k,m) at a particular frequency k and time instance m is based on a probability density function $p(|■|^2)$ of the energy for a number of previous time frames, e.g. corresponding to a sliding window (e.g. the $N_f$ previous time frames relative to a given (e.g. present) time frame, cf. e.g. FIG. 6).

An artifact identification measure AIDM(k,m), e.g. comprising a kurtosis ratio $KR(k,m)=K_2(k,m)/K_1(k,m)$, is determined in unit Kurtosis ratio based on the determined kurtosis values $K_1(k,m)$ and $K_2(k,m)$. A predetermined criterion regarding the value of the artifact identification measure is defined, e.g. $K_2(k,m)/K_1(k,m) \geq AIDM_{TH}$. In an embodiment, $AIDM_{TH} \geq 1.2$, e.g. $\geq 1.5$. If the predefined criterion is fulfilled by the artifact identification measure of a given TF-bin, an artifact at that frequency and time is identified.

Compared to the noise reduction system described in connection with FIG. 1, the system of FIG. 3B additionally comprises a model unit (Perceptual model unit in FIG. 2) comprising a perceptual model (e.g. a simple masking model), which is used to identify to which extent a given time-frequency unit (k,m) of the output signal z(n) (or a further processed version of z(n)) is masked (cf. e.g. FIG. 6), and, consequently, to which extent the kurtosis-ratio K(z(k,m))/K(x(z,m)) (cf. unit Kurtosis ratio [KR(k,m)])—in case an artifact is identified in the TF-unit (k,m) in question—should influence the gain $G_{NR}(k,m)$ applied to the signal x(n) (=x(k,m)) by the processing algorithm (cf. unit Apply NRG [$G_{NR}(k,m)$]). The gain control unit Compute NRG determines such resulting noise reduction gain (attenuation) $G_{NR}(k,m)$. The resulting noise reduction gain (attenuation) $G_{NR}(k,m)$ of a given TF-unit (k,m) is determined on the basis of the estimated signal to noise ratio SNR(k,m) of the signal x(n), a voice activity indication NOI(k,m), the determined kurtosis ratio KR(k,m), and an audibility parameter AUD(k,m).

This improved musical noise predictor can e.g. be used in an online noise-reduction system in a hearing instrument or other audio processing device, where parameters of the noise reduction system is continuously updated based on a musical noise predictor, such that the amount of noise reduction is always at a level where the noise reduction is maximum subject to the constraint that no musical noise is introduced (or that musical noise is minimized). A noise reduction system applying a band specific scheme is e.g. described in WO 2005/086536 A1.

Figure 4:
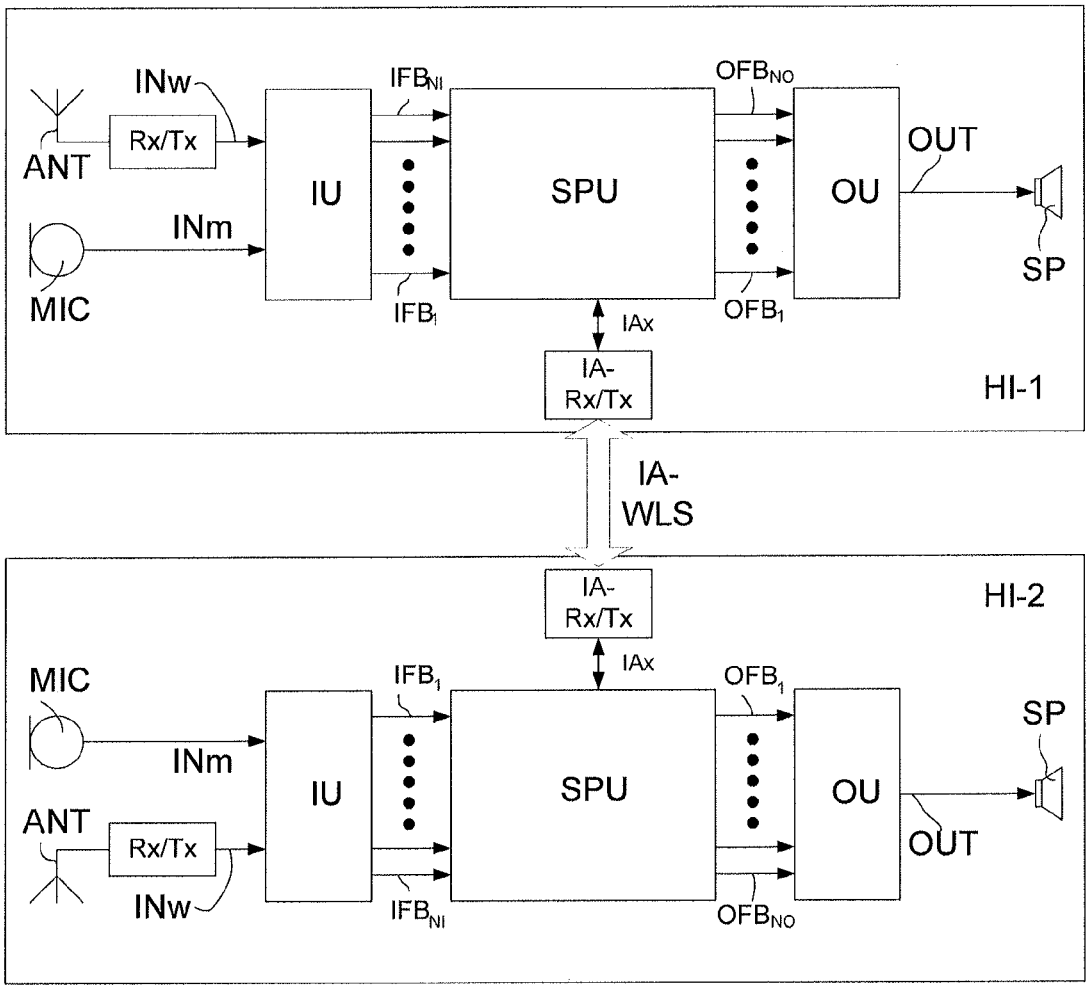
FIG. 4 shows an embodiment of a binaural audio processing system according to the present disclosure.

FIG. 4 shows an embodiment of a binaural audio processing system according to the present disclosure. The binaural audio processing system is here embodied in a binaural hearing aid system comprising first and second hearing instruments (HI-1, HI-2) adapted for being located at or in left and right ears of a user, respectively. The hearing instruments HI-1, HI-2 of the binaural hearing aid system of FIG. 4 are further adapted for exchanging information between them via a wireless communication link, e.g. a specific inter-aural (IA) wireless link (IA-WLS). The two hearing instruments HI-1, HI-2 are adapted to allow the exchange of status signals, e.g. including the transmission of characteristics of the input signal received by a device at a particular ear to the device at the other ear. To establish the inter-aural link, each hearing instrument comprises antenna and transceiver circuitry (here indicated by block IA-Rx/Tx). Each hearing instrument HI-1 and HI-2 is an embodiment of an audio processing devise as described in the present application (e.g. shown in and discussed in connection with FIG. 2 or 3). In the binaural hearing aid system of FIG. 4, a signal IAx generated by the processing unit (SPU) of one of the hearing instruments (e.g. HI-1) is transmitted to the other hearing instrument (e.g. HI-2) and/or vice versa. Signals IAx may (at a given point in time) comprise audio signals only, control signals only, or a combination of audio and control signals. The control signals from the local and the opposite device are e.g. used together to influence a decision or a parameter setting in the local device. The control signals may e.g. comprise information that enhances system quality to a user, e.g. improve signal processing, e.g. the execution of a processing algorithm. The control signals may e.g. comprise directional information or information relating to a classification of the current acoustic environment of the user wearing the hearing instruments, audibility of artifacts, etc. In an embodiment, the audio processing system further comprises an audio gateway device for receiving a number of audio signals and for transmitting at least one of the received audio signals to the audio processing devices (e.g. hearing instruments). In an embodiment, the audio processing system is adapted to provide that a telephone input signal can be received in the audio processing device(s) via the audio gateway. The hearing instruments HI-1, HI-2—in addition to a microphone (MIC) for picking up a sound signal in the environment—each comprise antenna (ANT) and transceiver circuitry (block Rx/Tx) to implement a wireless interface to an audio gateway or other audio delivery device, e.g. a telephone. The input unit (IU) is configured to select one of the input signals INw (from the wireless interface) or INm (from the microphone) or to provide a mixture of the two signals, and present the resulting signal to the signal processing unit (SPU) as a band-split (time-frequency) signal $IFB_1$-$IFB_{NI}$.

In an embodiment, the system is configured to control the gain of a noise reduction algorithm independently in each of the first and second hearing instruments. It may be a problem, however, if artifacts are 'detected' and thus attenuation reduced at one ear, but not at the other ear. Thus (at that frequency and time) gain will increase (because of a less aggressive noise reduction, e.g. by reducing attenuation from 10 dB to 4 dB) at the one ear relative to the other ear, which—in some instances—may erroneously be interpreted as spatial cues and thus cause confusion for the user.

In a preferred embodiment, information about the control of the noise reduction is exchanged between the first and second hearing instruments, e.g. via the inter-aural wireless link (IA-WLS), thus allowing a harmonized control of the noise reduction algorithms of the respective hearing instruments. Specifically, information about the control of gains of time-frequency regions for which gains should be increased (attenuation reduced) to reduce the risk of producing audible artifacts is exchanged between the first and second hearing instruments. Preferably, the same attenuation strategy is applied in first and second hearing instruments (at least regarding attenuation in time-frequency regions at risk of producing audible artifacts).

Figure 5:
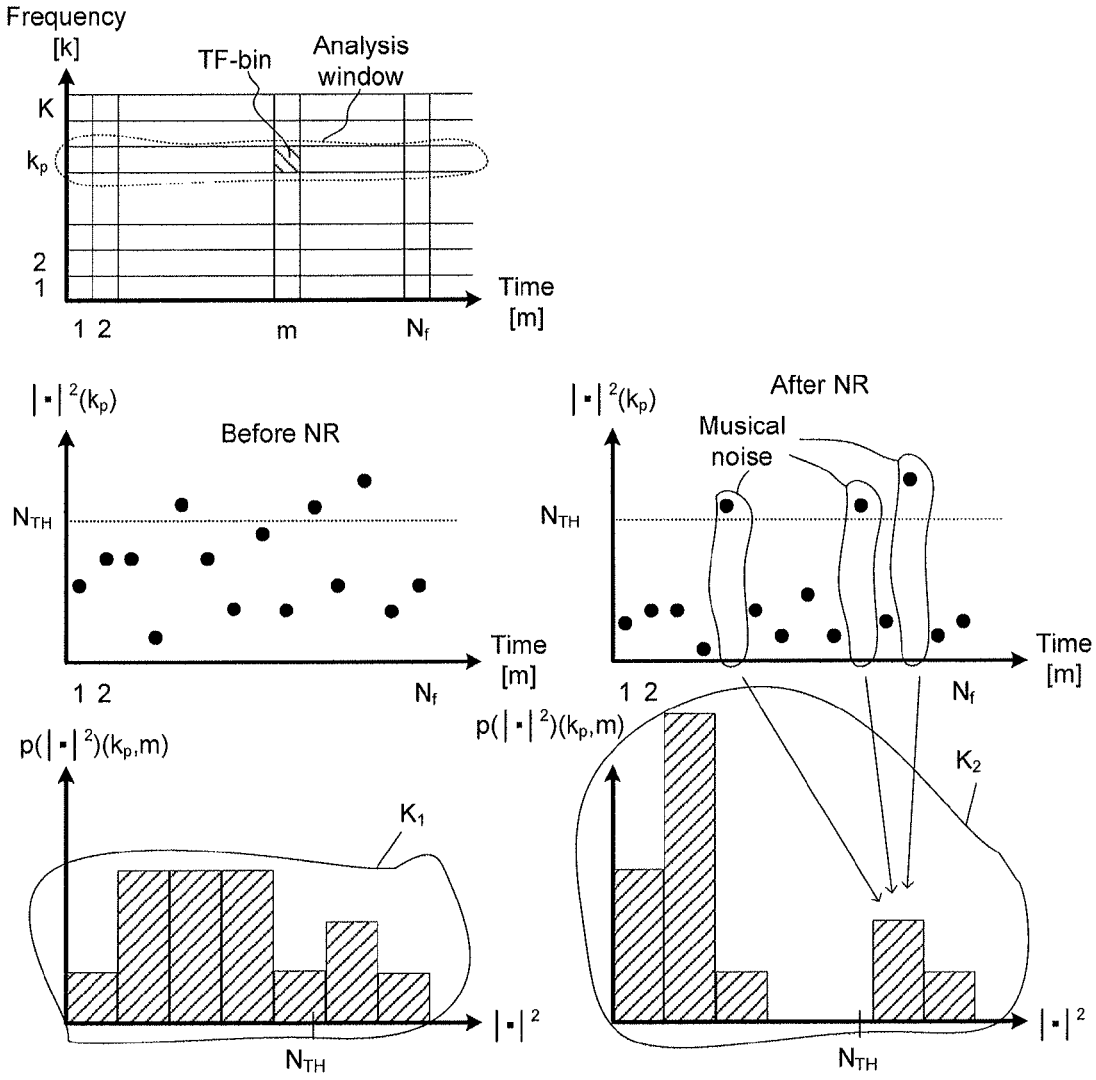
FIG. 5 shows schematic illustrations of the steps of determining a kurtosis parameter.

FIG. 5 shows schematic illustrations of the steps of determining a kurtosis parameter. Signals of the forward path before and after the processing algorithm (e.g. signals x and z, respectively, in FIG. 3B) are provided in a time-frequency representation, e.g. x(k,m), k being a frequency index and m being a time index. Such time-frequency representation is schematically illustrated in the top graph of FIG. 5. A specific time-frequency (TF) bin is defined by a specific combination of indices (k,m). The two middle graphs schematically illustrate a possible time variation (for a number $N_f$ of time frames) of values of magnitude squared of a noise signal before and after the application of processing algorithm (e.g. signals x and z, respectively, of FIG. 3B) at a particular frequency $k_p$. In a normal mode of operation of a noise reduction algorithm, a value of the magnitude (|■|) or (as indicated here) magnitude squared ($|■|^2$) of the input signal x in a particular time-frequency bin (k,m) below a predefined threshold value $N_{TH}$ (during a noise-only time period) may result in a predetermined attenuation (e.g. 6 dB) of the signal of that TF-bin. Correspondingly, a value larger than the threshold value $N_{TH}$ may result in no attenuation being applied to the contents of that TF-bin. This is illustrated in the two middle graphs, where three (high magnitude TF-bins at frequency $k_p$) are NOT attenuated resulting in 'musical noise'. According to the present disclosure, a kurtosis parameter $K(k_p,m)$ is determined for a probability density function of the energy (magnitude squared, $|\blacksquare|^2$) at a given frequency ($k_p$) and time (m) of a signal of the forward path of the audio processing device before ($K_1(k_p, m)$) and after ($K_2(k_p,m)$) the processing algorithm in question, e.g. a noise reduction algorithm. The bottom graphs of FIG. 6 illustrate schematic probability density functions $p(|\blacksquare|^2)$ for signals x and z extracted from the middle graphs of the time dependent signals. A kurtosis parameter $K(k_p,m)$ at a particular frequency $k_p$ and time instance m is based on a number of previous time frames, e.g. corresponding to a sliding window (e.g. the $N_f$ previous time frames relative to a given (e.g. present) time frame #m) as illustrated by the solid enclosure in the top graph of FIG. 6 denoted Analysis window. A kurtosis value (indicating a degree of peakedness) based on the respective bottom graphs will show an increase for the noise reduced signal (z, right graph) compared to the unprocessed signal (x, left graph). An artifact identification measure will thus be relatively large, and can be used as an indicator of artifacts (and thus an indicator of a risk of musical noise).

A masking model or an audibility model applied to an output signal (e.g. the noise reduced signal, or a further processed signal) is, however, preferably used to qualify the artifacts in audible and in-audible artifacts.

FIG. 6 shows a schematic perceptual model (here a masking model) for a noise signal at a given point in time, and an artefact identification measure AIDM implying a number of exemplary occurrences of artifacts (at the given point in time). FIG. 6 illustrates masking thresholds versus frequency k (dashed line) according to a masking model for a specific frequency dependence of the magnitude $|\blacksquare|$ of a noise signal picked up by an audio processing device according the present disclosure (solid line). Frequency ranges where the curve representing the masking thresholds is below the assumed noise level indicates frequencies where an artifact would be audible (here $k<k_x$), whereas frequency ranges where the curve representing the masking model is above the assumed noise level indicates frequencies where an artifact would be in audible (here $k>k_x$).

FIG. 7 shows a schematic example of magnitude $|\blacksquare|$ of a time variant input audio signal in a specific frequency band (kp) comprising time segments of noise-only and time segments of speech in noise the resulting analysis by a voice activity detector.

Figure 8:
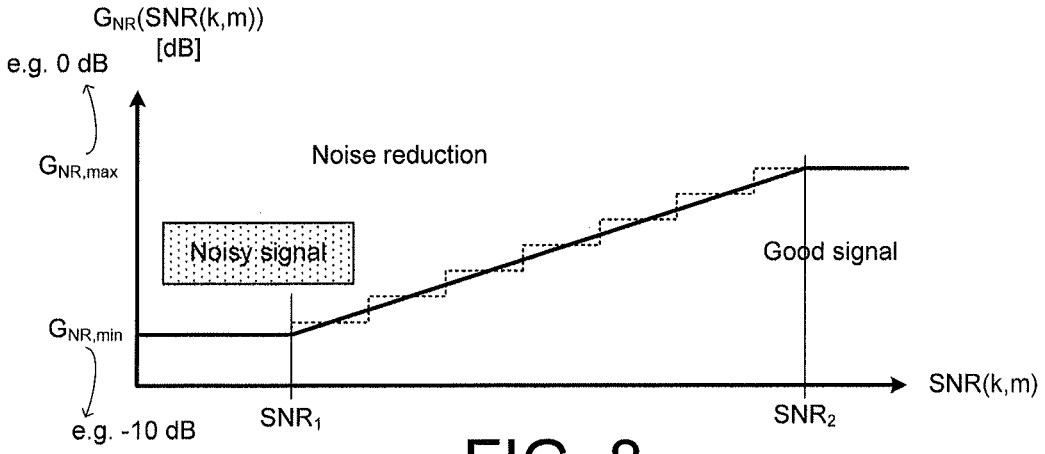
FIG. 8 shows a schematic example of the gain $G_{NR}$ applied by a noise reduction algorithm to a given TF-unit as a function of an estimated signal to noise ratio SNR of the TF-unit.

FIG. 8 shows a schematic example of the gain GNR applied by a noise reduction algorithm to a given TF-unit as a function of an estimated signal to noise ratio SNR of the TF-unit.

FIG. 8 illustrates a resulting gain $G_{NR}(SNR(k,m))$ applied to a particular TF-bin (k,m) of an audio signal of the forward path of an audio processing device by a noise reduction algorithm. The audio signal typically comprises a mixture of a target signal (e.g. a speech signal) and other sound elements, termed noise. The noise reduction algorithm has the purpose of attenuating noise parts of the audio signal (typically to thereby let the target signal 'stand out more conspicuously', and thereby increasing intelligibility). Typically an estimate of the signal to noise ratio (SNR) of the audio signal (e.g. in each frequency band of the signal) is determined at successive time instances (e.g. in every time frame, e.g. at time intervals of the order of ms, e.g. 3.2 ms). This estimate is e.g. used to determine a gain (attenuation) applied to the audio signal (preferably in a specific frequency bands or bands) by the noise reduction algorithm. The gain applied by the noise reduction algorithm is typically allowed to vary between a minimum value $G_{NR,min}$ (maximum attenuation, e.g. −10 dB) and a maximum value $G_{NR,max}$ (minimum attenuation, e.g. no gain, 0 dB). In an embodiment, the minimum gain $G_{NR,min}$ is applied to the signal (or frequency bands) at relatively low signal to noise ratios (e.g. below $SNR_1$ in FIG. 8, indicated as 'Noisy signal'), and the maximum gain $G_{NR,max}$ is applied to the signal (or frequency bands) at relatively high signal to noise ratios (e.g. above $SNR_2$ in FIG. 8, indicated as 'Good signal'). In an intermediate range between relatively low and relatively high signal to noise ratios, the gain $G_{NR}$ applied by the noise reduction algorithm is increased from $G_{NR,min}$ to $G_{NR,max}$, e.g. in steps (dotted line), or linearly (solid line), or according to any other continuous function, with increasing SNR, cf. e.g. FIG. 8.

Preferably, a perceptive noise reduction scheme as proposed in the present application is implemented. When an artifact identification measure AIDM(k,m) (e.g. a kurtosis ratio) for the particular TF-unit (k,m) is smaller than a threshold value $AIDM_{TH}$, no risk of introducing artifacts is identified, and a normal operation of the noise reduction algorithm is applied (as described above for FIG. 8, here shown to be the application of a minimum gain $G_{NR,min}$, i.e. a predefined maximum attenuation), e.g. attenuating the magnitude of the TF-bin in question with a predefined amount, e.g. 10 dB, if the contents of the TF-bin is characterized as noise (e.g. by a voice activity detector (cf. e.g. FIG. 9A) and/or by an SNR-analysis unit and/or by a frequency analysis unit). If, on the other hand, the measure AIDM(k,m) is larger than the threshold value $AIDM_{TH}$, a risk of introducing artifacts is present, and a modified operation of the noise reduction algorithm is applied (based on a perceptual model, cf. e.g. FIG. 6).

The algorithm ALG is assumed to have a specific form for determining a gain for a given TF bin, when artifacts are not considered (normal mode).

According to the present disclosure, where artifacts are identified using an artifact identification measure AIDM that is calculated on a TF bin basis, AIDM(k,m), a modification $\Delta G_{ALG}$ of the 'normal' gain is proposed when artifacts can be identified.

In an embodiment, $\Delta G_{ALG}$ is identical for all values of k and m. In an embodiment, $\Delta G_{ALG}$ is dependent on frequency (index k). In an embodiment, $\Delta G_{ALG}$ is dependent on the artifact identification measure AIDM(k,m).

In an embodiment, a speech or voice activity detector is configured to determine whether the audio signal (either the full signal and/or specific time-frequency elements of the signal) at a given time contain speech elements. For a noise reduction algorithm, a modification $\Delta G_{NR}$ of the 'normal' gain ($G_{NR}$ in FIG. 8) is proposed, when artifacts can be identified according to the following scheme:

- $G_{NR}(k,m)=G_{NR}(k,m^{-1})+\Delta G_{NR}$ [dB], if artifacts are detected during noise only (effectively, increase $G_{NR,min}$);
- $G_{NR}(k,m)=G_{NR}(k,m^{-1})-\Delta G_{NR}$ [dB], if no artifacts are detected during noise only (effectively, decrease $G_{NR,min}$); and
- $G_{NR}(k,m)=G_{NR}(k,m^{-1})$ [dB], if speech is detected (effectively, keep $G_{NR}$ at the value 'arrived at' during a noise only period);

under the constraint that $G_{NR0,min}(k,m)\leq G_{NR}(k,m)\leq G_{NR0,max}(k,m)$, where $G_{NR0,min}(k,m)$ and $G_{NR0,max}(k,m)$ are predetermined minimum and maximum values, respectively, of the gain ($G_{NR}$) applied by the noise reduction algorithm (e.g. −10 dB and 0 dB, respectively).

Preferably the rate of change of the modification is limited, the rate of change being defined by $\Delta G_{NR}$ and the time interval $t_F$ between successive time frames of the signal. In an embodiment, a time frame has a duration of between 0.5 ms and 30 ms, depending on the application in question (and determine by the length in time of one sample (determined by the sampling rate $f_s$) and the number of samples per time frame, e.g. $2^n$, n being a positive integer, e.g. larger than or equal to 6). A relatively short time frame enables a system with a relatively low latency (e.g. necessary in applications where a transmitted sound signal is intended to be in synchrony with an image, e.g. a live image, such as e.g. in hearing aid system). Relatively longer time frames results in higher system latency, but may be acceptable in other applications, however, e.g. in cell phone systems.

In an embodiment, $\Delta G_{NR}$ is adaptively determined in dependence of the size of the artifact identification measure (AIDM), e.g. so that $\Delta G_{NR}$ is larger the larger AIDM(k,m) (e.g. proportional to AIDM).

Figure 9A:
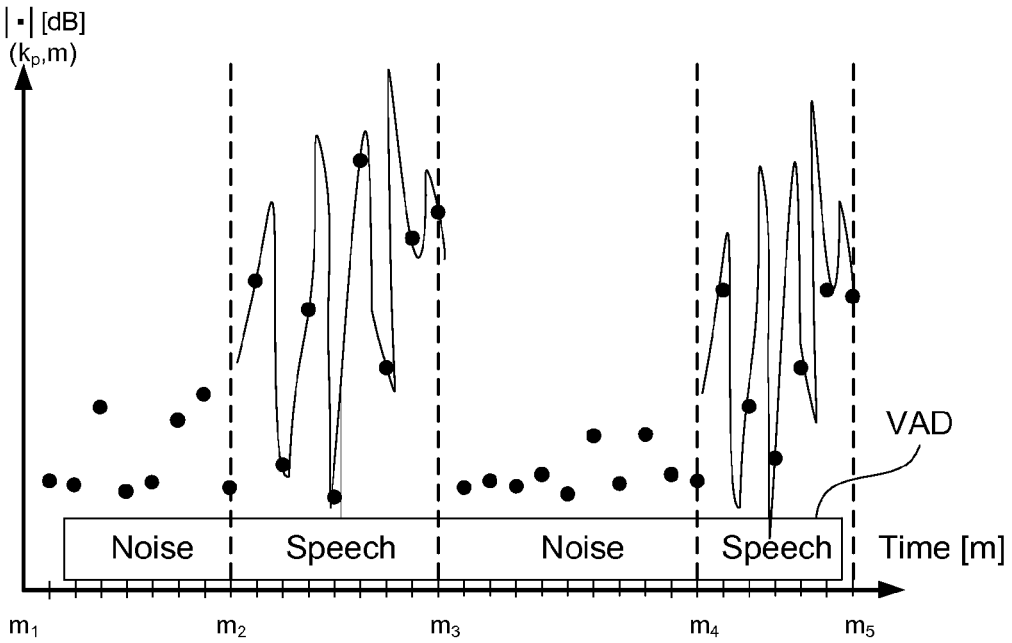
FIG. 9 illustrates in FIG. 9C a resulting minimum gain $G_{NR,min}(k,m)$ applied to a particular frequency band ($k_p$,m) of a signal of the forward path of an audio processing device by a noise reduction algorithm implementing a perceptive noise reduction scheme as proposed in the present application, FIG. 9A schematically showing time segments of the processed audio signal of the forward path (after noise reduction) for the frequency band $k_p$ in question, and FIG. 9B showing identified artifacts at particular points in time of the noise-only time segments at the frequency band $k_p$ in question, and indicate an estimate of their audibility ('a') or inaudibility ('ia').
Figure 9B:
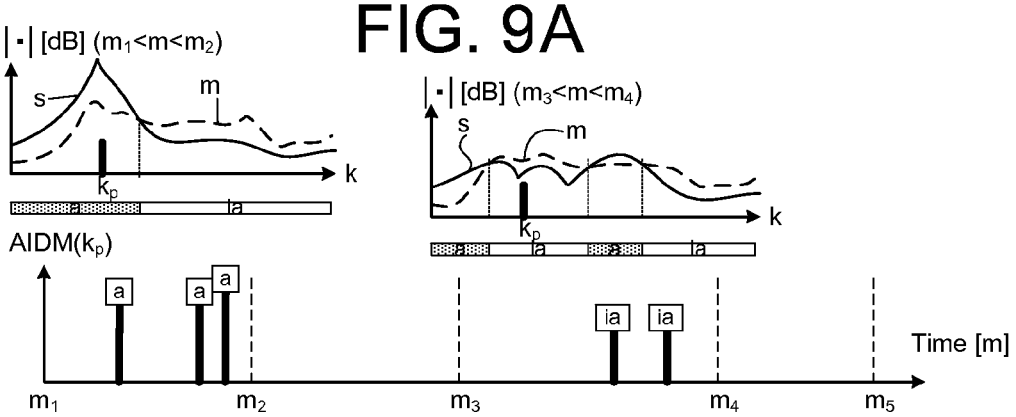
Figure 9C:
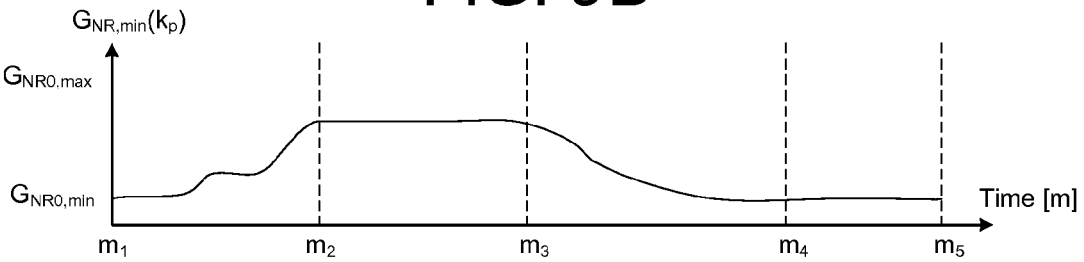

FIG. 9 illustrates in FIG. 9C a resulting minimum gain $G_{NR,min}(k,m)$ applied to a particular frequency band ($k_p$,m) of a signal of the forward path of an audio processing device by a noise reduction algorithm implementing a perceptive noise reduction scheme as proposed in the present application, FIG. 9A schematically showing time segments of the processed audio signal of the forward path (after noise reduction) for the frequency band $k_p$ in question, and FIG. 9B showing identified artifacts at particular points in time of the noise-only time segments at the frequency band $k_p$ in question, and indicate an estimate of their audibility ('a') or inaudibility ('ia').

Typically, the 'noise only' periods of time are (by definition) periods of time with a low signal to noise ratio (see indication 'noisy signal' in FIG. 8). Hence, in practice (in an embodiment), the modification of the noise reduction algorithm provided by the present disclosure is a modification of the minimum gain $G_{NR,min}$ (cf. e.g. FIG. 8) applied to frequency components (TF bins) of a signal (in case an artifact is identified AND considered audible) to make the noise reduction less aggressive (i.e. increase $G_{NR,min}$,=>less attenuation), in practice to increase the minimum gain level (while keeping the maximum gain $G_{NR,max}$ constant) thereby minimizing the dynamic range of attenuation available to the noise reduction algorithm, as indicated in FIG. 9: The graph of FIG. 9C illustrates a modification of $G_{NR,min}(k_p,m)$ (when audible artifacts are identified) within a dynamic range between predetermined minimum and maximum values $G_{NR0,min}(k,m)$ and $G_{NR0,max}(k,m)$, respectively, for a specific time variant input signal of the forward path of a listening device (at a particular frequency $k_p$) according to the present disclosure, as illustrated in the graph of FIG. 9A. The time variant input signal comprises the same alternating time segments of noise only and speech (in noise), respectively, at a particular frequency $k_p$, as illustrated and discussed in connection with FIG. 7. The graph in FIG. 9B indicates the occurrence in time of (identified) artifacts during the noise-only time periods. Each artifact is symbolized by a bold vertical line occurring at a particular point in time and denoted 'a' or 'ia' in a square enclosure, depending on its estimated audibility and inaudibility, respectively. The artifacts occurring in the first noise-only time segment (between time indices $m_1$ and $m_2$) are judged by the perceptual model to be audible ('a') as also indicated by the small graphical insert (above the artifacts, in the left part FIG. 9B). The insert schematically illustrates the noise signal spectrum, masking thresholds (as determined by a perceptual model) and the occurrence of (identified) artifacts at the relevant time. The noise spectrum (solid line) and masking thresholds (dashed line) in the above insert in principle corresponds to one particular time instance, but all three artifacts are assumed to occur at points in time where the masking threshold are so that the artifact in question is audible. Conversely, the artifacts occurring in the second noise-only time segment (between time indices $m_3$ and $m_4$) are judged by the perceptual model to be inaudible ('ia') as also indicated by the small graphical insert (above the artifacts, in the right part of FIG. 9B).

Preferably, the steps $\Delta G_{NR}$ and the frame length in time ($t_F$ determining a time unit from time index m to time index m+1) are configured to provide that an adaptation rate of the noise reduction gain $G_{NR}(k,m)$—when artifacts are detected—is a compromise between the risk of creating artifacts in the processed signal of the forward path and the wish to ensure an aggressive noise reduction. In an embodiment, $\Delta G_{NR}$ and $t_F$ are selected to provide that the adaptation rate of $G_{NR}(k,m)$ is in the range from 0.5 dB/s to 5 dB/s. An exemplary frame length $t_F$ of 5 ms and an adaptation rate of 2.5 dB/s leads for example to a step size per time unit $\Delta G_{NR}$ of 0.0125 dB ($\Delta G_{NR}/t_F$=AR).

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof.

REFERENCES

EP 2 463 856 A1

[Uemura et al.; 2012] Y. Uemura et al., "Automatic Optimization Scheme of Spectral Subtraction based on Musical Noise Assessment via higher-order statistics," Proc. ICASSP 2012.

[Yu & Fingerscheidt; 2012] H. Yu, and T. Fingscheidt, "Black Box Measurement of Musical Tones Produced by Noise Reduction Systems," Proc. ICASSP 2012.

[Uemura et al.; 2009] Y. Uemura et al., "Musical Noise Generation Analysis for Nosie Reduction Methods Based on Spectral Subtraction and MMSE STSA Estimation", Proc. ICASSP 2009, pp 4433-4436.

EP 2 144 233 A2

[Berouti et al.; 1979] M. Berouti, R. Schwartz and J. Makhoul, "Enhancement of speech corrupted by acoustic noise" Proc IEEE ICASSP, 1979, 4, pp. 208-211.

[Cappe; 1994] Olivier Cappe, "Elimination of the Musical Noise Phenomenon with the Ephraim and Malah Noise Suppressor," IEEE Trans. on Speech and Audio Proc., vol. 2, No. 2, April 1994, pp. 345-349.

[Linhard et al.; 1997] Klaus Linhard and Heinz Klemm, "Noise reduction with spectral subtraction and median filtering for suppression of musical tones," Proc. of ESCA-NATO Workshop on Robust Speech Recognition for Unknown Communication Channels, 1997, pp 159-162.

[Fastl & Zwicker, 2007] H. Fastl, E. Zwicker, Psychoacoustics, Facts and Models, 3rd edition, Springer, 2007, ISBN 10 3-540-23159-5.

The invention claimed is:

1. An audio processing device, comprising:

a forward path including an input unit for delivering a time varying electric input signal representing an audio signal, the electric input signal comprising a target signal part and a noise signal part;

a signal processing unit for applying a processing algorithm to said electric input signal and providing a processed signal; and an output unit for delivering an output signal based on said processed signal;

an analysis path including a model unit comprising a perceptive model of the human auditory system and providing an audibility measure;

an artifact identification unit for identifying an artifact introduced into the processed signal by the processing algorithm and providing an artifact identification measure; and a gain control unit for controlling a gain applied to a signal of the forward path by the processing algorithm based on inputs from said model unit and said artifact identification unit; and a time to time-frequency conversion unit for converting a time domain signal to a frequency domain signal, wherein the time-frequency conversion unit is configured to provide a time-frequency representation of a signal of the forward path in a number of frequency bands k and a number of time instances m, k being a frequency band index and m being a time index, (k, m) thus defining a specific time-frequency bin or unit comprising a complex or real value of the signal corresponding to time instance m and frequency index k.

2. An audio processing device according to claim 1 wherein a predetermined criterion regarding values of said artifact identification measure indicating the presence of an artifact in a given time-frequency bin (k,m) is defined.

3. An audio processing device according to claim 1 wherein said artifact identification unit is configured to determine artifacts based on a measure of kurtosis for one or more signals of the forward path.

4. An audio processing device according to claim 3 wherein said artifact identification unit is configured to determine said artifact identification measure by comparing a kurtosis value based on said electric input signal or a signal originating there from with a kurtosis value based on said processed signal.

5. An audio processing device according to claim 4 wherein said artifact identification measure AIDM(k,m) is based on the kurtosis values $K_b(k,m)$ and $K_a(k,m)$ of said input signal or a signal originating there from and of said processed signal, respectively.

6. An audio processing device according to claim 5 wherein said predetermined criterion is defined by a kurtosis ratio $K_a(k,m)/K_b(k,m)$ being larger than or equal to a predefined threshold value $AIDM_{TH}$.

7. An audio processing device according to claim 1 comprising a signal-to-noise-ratio unit for dynamically estimating a signal-to-noise-ratio value based on estimates of at least one of said target signal part and said noise signal part.

8. An audio processing device according to claim 1 comprising a voice activity detector VAD configured to indicate whether or not a human voice is present in the input audio signal at a given point in time.

9. An audio processing device according to claim 1 wherein the perceptive model comprises a masking model configured to identify to which extent an identified artifact of a given time-frequency unit of the processed signal or a signal derived there from is masked by other elements of the current signal.

10. An audio processing device, comprising:

a forward path including an input unit for delivering a time varying electric input signal representing an audio signal, the electric input signal comprising a target signal part and a noise signal part;

a signal processing unit for applying a processing algorithm to said electric input signal and providing a processed signal; and an output unit for delivering an output signal based on said processed signal; and an analysis path including a model unit comprising a perceptive model of the human auditory system and providing an audibility measure;

an artifact identification unit for identifying an artifact introduced into the processed signal by the processing algorithm and providing an artifact identification measure; and a gain control unit for controlling a gain applied to a signal of the forward path by the processing algorithm based on inputs from said model unit and said artifact identification unit, wherein said artifact identification unit is configured to determine artifacts based on a measure of kurtosis for one or more signals of the forward path, and configured to determine said artifact identification measure by comparing a kurtosis value based on said electric input signal or a signal originating there from with a kurtosis value based on said processed signal, and the audio processing device is configured to perform the analysis of kurtosis during time spans where no voice is present in the electric input signal.

11. An audio processing device, comprising:

a forward path including an input unit for delivering a time varying electric input signal representing an audio signal, the electric input signal comprising a target signal part and a noise signal part;

a signal processing unit for applying a processing algorithm said electric input signal and providing a processed signal; and an output unit for delivering an output signal based on said processed signal; and an analysis path including a model unit comprising a perceptive model of the human auditory system and providing an audibility measure;

an artifact identification unit for identifying an artifact introduced into the processed signal by the processing algorithm and providing an artifact identification measure; and a gain control unit for controlling a gain applied to a signal of the forward path by the processing algorithm based on inputs from said model unit and said artifact identification unit, wherein the processing algorithm comprises a noise reduction algorithm.

12. An audio processing device according to claim 11 wherein the noise reduction algorithm is configured to vary the gain between a minimum value and a maximum value.

13. An audio processing device according to claim 12 wherein the noise reduction algorithm is configured to vary the gain in dependence of a signal-to-noise ratio value based on estimates of at least one of said target signal part and said noise signal part.

14. An audio processing device according to claim 11 wherein the gain control unit is configured to dynamically modify the gain of the noise reduction algorithm otherwise intended to be applied by the algorithm to provide that the amount of noise reduction is always at a maximum level subject to the constraint that no musical noise is introduced.

15. The audio processing device according to claim 11, wherein the noise reduction algorithm is a single channel noise reduction (SC NR) algorithm.

16. An audio processing device, comprising:

a forward path including an input unit for delivering a time varying electric input signal representing an audio signal, the electric input signal comprising a target signal part and a noise signal part;

a signal processing unit for applying a processing algorithm to said electric input signal and providing a processed signal; and an output unit for delivering an output signal based on said processed signal; and an analysis path including a model unit comprising a perceptive model of the human auditory system and providing an audibility measure;

an artifact identification unit for identifying an artifact introduced into the processed signal by the processing algorithm and providing an artifact identification measure; and a gain control unit for controlling a gain applied to a signal of the forward path by the processing algorithm based on inputs from said model unit and said artifact identification unit, wherein the gain control unit is configured to modify a gain of the processing algorithm, if an artifact is identified.

17. An audio processing device according to claim 16 wherein the modification comprises that a reduction of a gain otherwise intended to be applied by the processing algorithm is reduced with a predefined amount.

18. An audio processing device according to claim 16 wherein said modification comprises that a reduction of gain otherwise intended to be applied by the processing algorithm is gradually modified in dependence of the size of the artifact identification measure.

19. An audio processing device according to claim 16 wherein said gain control unit is configured to limit a rate of said modification.

20. The audio processing device according to claim 19, wherein said gain control unit is configured to limit a rate of said modification to a value between 0.5 dB/s and 5 dB/s.

* * * * *